US010431172B2

(12) United States Patent
Kim et al.

(10) Patent No.: US 10,431,172 B2
(45) Date of Patent: Oct. 1, 2019

(54) DISPLAY DEVICE AND METHOD OF DRIVING THE SAME

(71) Applicant: LG Display Co., Ltd., Seoul (KR)

(72) Inventors: Joondong Kim, Paju-si (KR); Kimin Son, Yongin-si (KR)

(73) Assignee: LG Display Co., Ltd., Seoul (KR)

( * ) Notice: Subject to any disclaimer, the term of this patent is extended or adjusted under 35 U.S.C. 154(b) by 106 days.

(21) Appl. No.: 15/681,977

(22) Filed: Aug. 21, 2017

(65) Prior Publication Data

US 2018/0061343 A1 Mar. 1, 2018

(30) Foreign Application Priority Data

Aug. 31, 2016 (KR) ..... 10-2016-0111807

(51) Int. Cl.
*G09G 3/36* (2006.01)

(52) U.S. Cl.
CPC ..... *G09G 3/3648* (2013.01); *G09G 3/364* (2013.01); *G09G 3/3666* (2013.01); *G09G 2300/0426* (2013.01); *G09G 2300/0439* (2013.01); *G09G 2300/0823* (2013.01); *G09G 2330/04* (2013.01)

(58) Field of Classification Search
CPC ..... G09G 5/18; G09G 3/20; G09G 3/3275; G09G 3/3648
See application file for complete search history.

(56) References Cited

U.S. PATENT DOCUMENTS

2002/0154076 A1* 10/2002 Greene ..... G02F 1/1345 345/87
2005/0052439 A1* 3/2005 Liou ..... G09G 3/20 345/204
2015/0022515 A1* 1/2015 Ikeda ..... G09G 3/3275 345/212
2015/0262554 A1* 9/2015 Park ..... G09G 5/18 345/212

* cited by examiner

*Primary Examiner* — Sepehr Azari
(74) *Attorney, Agent, or Firm* — Fenwick & West LLP

(57) ABSTRACT

A display device and a method of driving the same are disclosed. The display device includes a display panel configured to display an image, a plurality of data lines arranged in a first diagonal direction of the display panel, a plurality of scan lines arranged in a second diagonal direction intersecting the first diagonal direction of the display panel, a plurality of data drivers connected to the plurality of data lines, and a plurality of scan drivers connected to the plurality of scan lines.

12 Claims, 20 Drawing Sheets

(a)

(b)

(a)

(b)

(a)

(b)

DISPLAY DEVICE AND METHOD OF DRIVING THE SAME

CROSS-REFERENCE TO RELATED APPLICATIONS

This application claims the benefit of Republic of Korea Patent Application No. 10-2016-0111807 filed on Aug. 31, 2016, which is incorporated herein by reference in its entirety.

BACKGROUND

Field of Technology

The present disclosure relates to a display device and a method of driving the same.

Discussion of the Related Art

With the advancement of information technologies, the demands for display devices which enable a user to access information have increased. Accordingly, various types of the display devices are widely used, such as organic light emitting display (OLED), electrophoretic display device (ED), liquid crystal display (LCD), and plasma display panel (PDP).

The display devices include a display panel having a plurality of subpixels, and a driver configured to drive the display panel. The driver includes a scan driver configured to supply a scan signal (or a gate signal) to the display panel, and a data driver configured to supply a data signal to the display panel.

Some of the above-described display devices may be provided with a flexible substrate to bend the display panel or to have a curved surface, as well as to deform the display panel in a rolled shape or an unrolled shape.

When the flexibility is given to the substrate constituting the display panel, it is possible to deform the display panel in a rolled shape or an unrolled shape. However, elements (for example, thin film transistors in the subpixels) or signal lines formed in the display panel are exposed to stresses transmitted in various directions every time a shape change such as bending of the display panel occurs. When these stresses are constantly applied to the display panel, thin films constituting the element, the signal lines, etc. may cause physical and structural damage in a form of cracks or separation (pattern lifting), and measures are needed to mitigate them.

SUMMARY

In one aspect, there is provided a display device including a display panel configured to display an image, a plurality of data lines arranged in a first diagonal direction of the display panel, a plurality of scan lines arranged in a second diagonal direction intersecting the first diagonal direction of the display panel, a plurality of data drivers connected to the plurality of data lines, and a plurality of scan drivers connected to the plurality of scan lines.

In another aspect, there is provided a method of driving a display device including a display panel including subpixels defined by a plurality of data lines arranged in a first diagonal direction and a plurality of scan lines arranged in a second diagonal direction intersecting the first diagonal direction. The method includes outputting a scan signal from a lower second diagonal direction to an upper second diagonal direction of the display panel by driving some of plurality of scan drivers, and outputting a data signal from an upper first diagonal direction to a lower first diagonal direction of the display panel by driving some of plurality of data drivers, and outputting a scan signal from the upper second diagonal direction to the lower second diagonal direction of the display panel by driving remaining drivers of the plurality of scan drivers, and outputting a data signal from the lower first diagonal direction to the upper first diagonal direction of the display panel by driving remaining drivers of the plurality of data drivers.

In the other aspect, there is provided a method of driving a display device including a display panel including subpixels defined by a plurality of data lines arranged in a first diagonal direction and a plurality of scan lines arranged in a second diagonal direction intersecting the first diagonal direction. The method includes a first block driving step of outputting a scan signal from a lower second diagonal direction to an upper second diagonal direction of the display panel by driving first lower scan drivers, outputting a data signal from an upper first diagonal direction to a lower first diagonal direction of the display panel by driving first upper data drivers, outputting a scan signal from the upper second diagonal direction to the lower second diagonal direction of the display panel by driving first upper scan drivers simultaneously with the first lower scan drivers, and outputting a data signal from the lower first diagonal direction to the upper first diagonal direction of the display panel by driving first lower data drivers simultaneously with the first upper data drivers, and a second block driving step of outputting a scan signal from the lower second diagonal direction to the upper second diagonal direction of the display panel by driving second lower scan drivers, outputting a data signal from the upper first diagonal direction to the lower first diagonal direction of the display panel by driving second upper data drivers, outputting a scan signal from the upper second diagonal direction to the lower second diagonal direction of the display panel by driving second upper scan drivers simultaneously with the second lower scan drivers, and outputting a data signal from the lower first diagonal direction to the upper first diagonal direction of the display panel by driving second lower data drivers simultaneously with the second upper data drivers.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Reference will now be made in detail embodiments of the invention examples of which are illustrated in the accompanying drawings.

Hereinafter, detailed embodiments of the invention will be described with reference to the accompanying drawings.

The invention described below is applicable to a planar display panel generally used. However, according to the invention described below, in an instance of implementing a display device in which a display panel is deformed in a rolled shape or an unrolled shape, it is possible to prevent physical and structural damage such as cracks or separation (pattern lifting) of a thin film, thereby achieving a better effect than when implementing the planar display panel.

In the following description, a rollable display device is implemented as an example of an organic light emitting display device. However, the rollable display device is not limited thereto because the rollable display device can be a display panel capable of imparting flexibility to a substrate, such as an electrophoretic display device (ED), a liquid crystal display (LCD), and the like.

Figure 1:
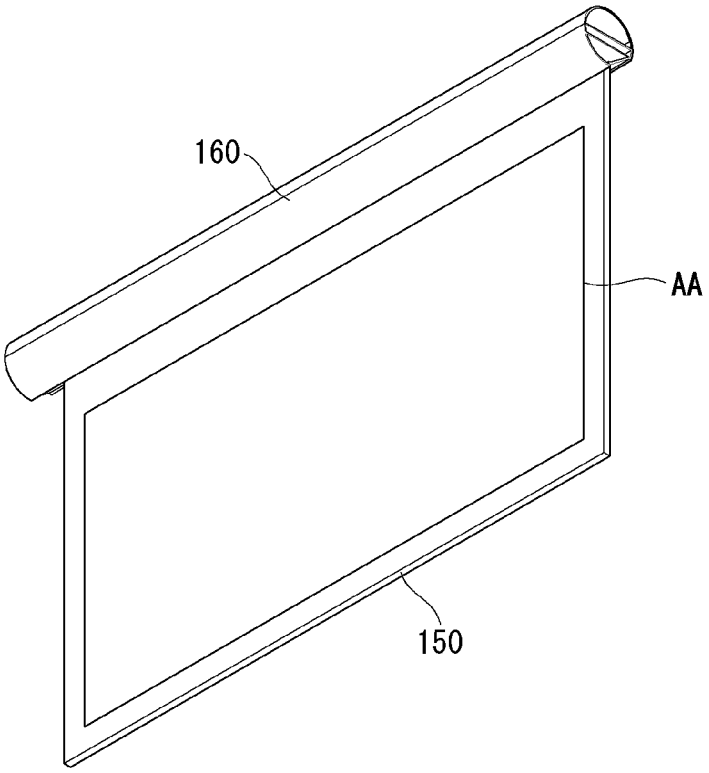
FIG. 1 is a view illustrating a rollable display device according to one embodiment.
Figure 2:
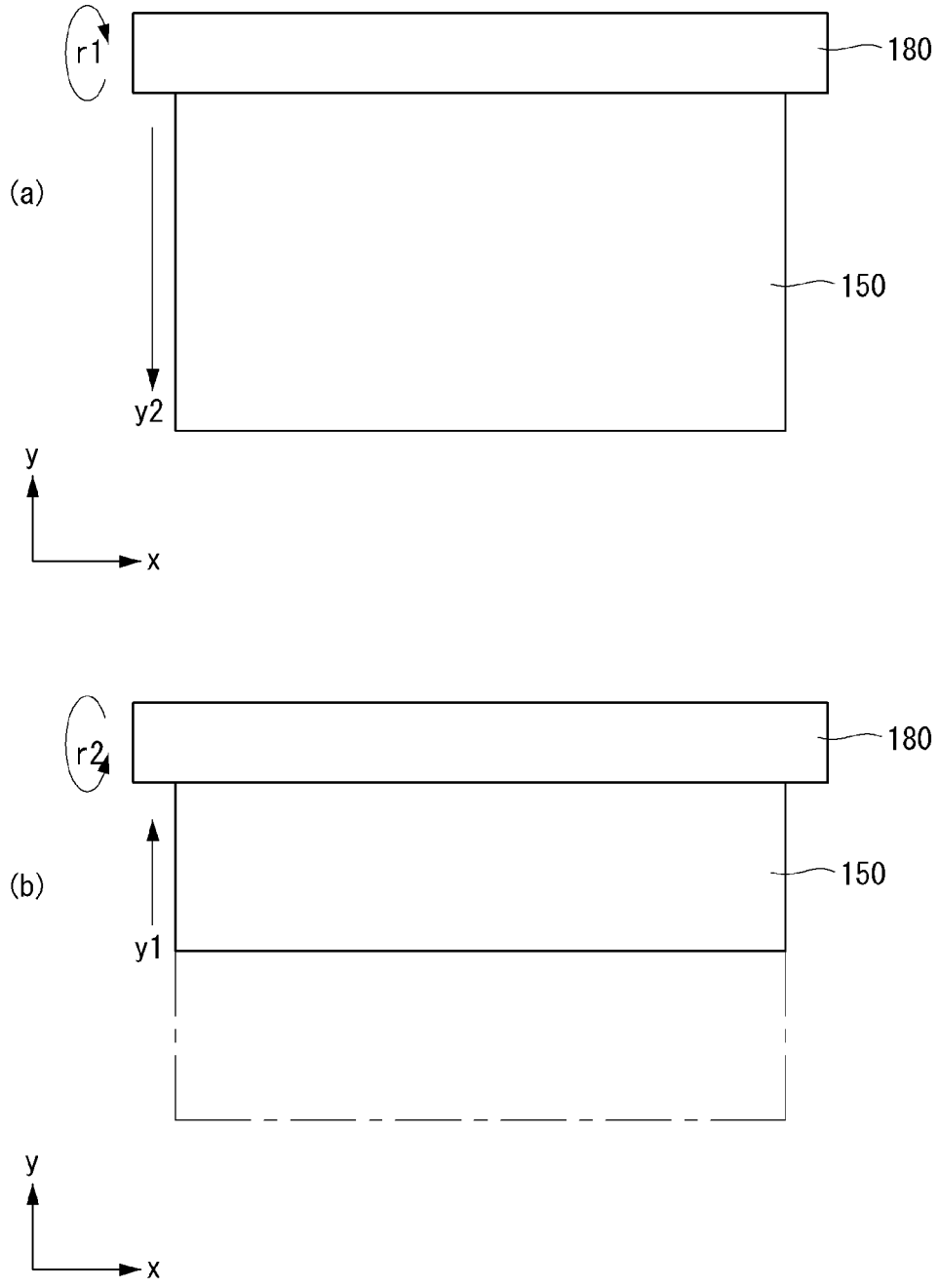
FIG. 2 is a view schematically illustrating a concept of a rollable display device according to one embodiment.

FIG. 1 is a view illustrating a rollable display device, and FIG. 2 is a view schematically illustrating a concept of a rollable display device.

As shown in FIGS. 1 and 2, the rollable display device includes a modular display panel 150 (hereinafter, referred to as a display panel), a panel roller 160, and a housing 180.

The display panel 150 has a module form in which a scan driver and a data driver are mounted. The display panel 150 is formed based on a flexible substrate (or film). In the display panel 150, sub-pixels including a thin film transistor and an organic light emitting diode are arranged.

The panel roller 160 is formed in a cylindrical shape. The panel roller 160 provides a structure which enables rolling the display panel 150 around an outer circumferential surface of the panel roller 160 and unrolling the display panel 150 therefrom. The panel roller 160 is accommodated in the housing 180.

The housing 180 accommodates the display panel 150 and the panel roller 160. A driving device for electrically rotating the panel roller 160, such as a motor, a gear, and a power supply, may be included in an inside of the housing 180. Therefore, the housing 180 may be designed in a circular shape, an elliptical shape, a quadrangular shape, a rectangular shape, or polygonal shape depending on configuration or design of the driving device.

The display panel 150 comes out of the housing 180 or enters the inside of the housing 180 depending on a direction of rotation of the driving device. For example, when the driving device rotates in a direction r1, as shown in (a) of FIG. 2, the panel roller 160 may unroll the display panel 150 rolled up around its outer circumferential surface.

In this instance, the display panel 150 moves in a direction y2, and therefore comes out of the housing 180. On the contrary, when the driving device rotates in a direction r2, as shown in (b) of FIG. 2, the panel roller 160 rolls up the display panel 150 around its outer circumferential surface. In this instance, the display panel 150 moves in a direction y1 and therefore goes into the inside the housing 180.

Hereinafter, a structure of an experimental example and its problems will be discussed, and embodiments for improving the problems caused by the examples will be described.

EXAMPLE

Figure 3:
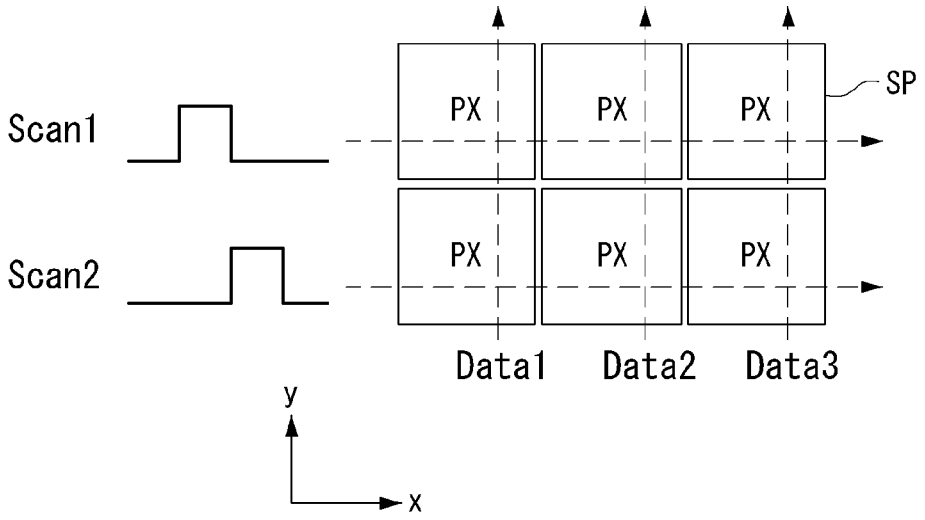
FIG. 3 is an exemplary view of subpixels arranged in a display panel according to one embodiment.
Figure 4:
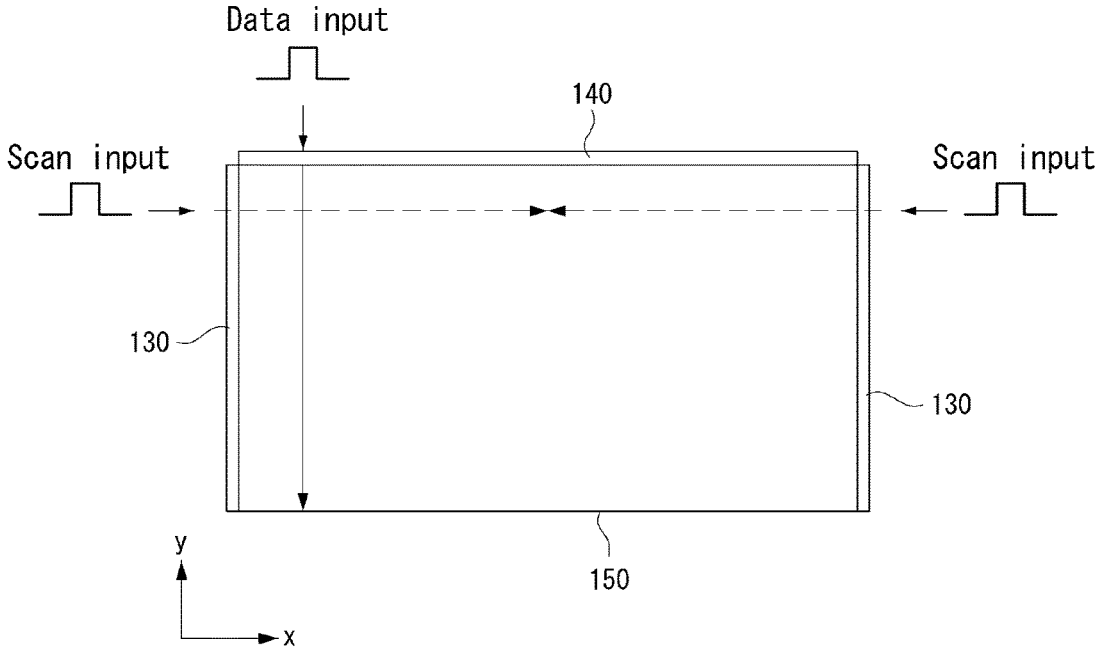
FIG. 4 is an exemplary view of signal lines arranged in a display panel according to one embodiment.
Figure 5:
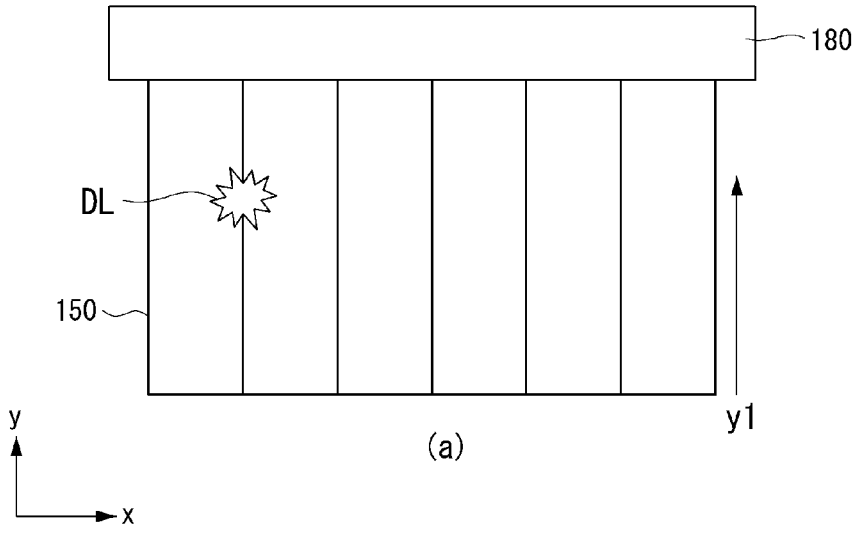
FIG. 5 is a view for explaining a problem of a display panel according to one embodiment.
Figure 5:
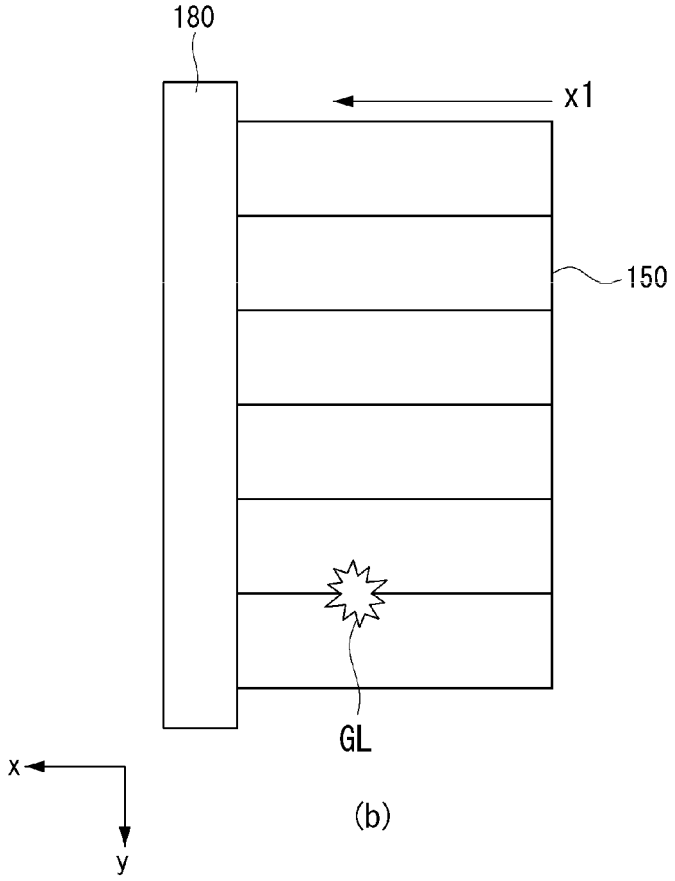

FIG. 3 is an exemplary view of subpixels arranged in a display panel, FIG. 4 is an exemplary view of signal lines arranged in a display panel, and FIG. 5 is a view for explaining a problem of a display panel.

As shown in FIGS. 3 to 5, the subpixels SP are arranged in the display panel 150. The subpixels SP have a rectangular shape which have the same length of four sides or a rectangular shape in which lengths of two sides are longer than those of the other two sides. The subpixels SP are arranged in a linear direction along x axis and y axis (hereinafter, referred to as horizontal and vertical directions) of the display panel 150.

Data lines DL are arranged in a vertical direction y of the display panel 150 and scan lines GL are arranged in a horizontal direction x of the display panel 150. A data driver 140 for supplying a data signal through the data lines DL in the vertical direction y is arranged on an upper side of the display panel 150, and scan drivers 130 for supplying a scan signal through the scan lines GL in the horizontal direction x are arranged on left and right sides of the display panel 150.

Unlike the illustration, the scan driver 130 may be arranged only on the left side or only the right side of the display panel 150. The data driver 140 may be arranged on a lower side of the display panel 150, or on both the upper side and the lower side of the display panel 150. In FIG. 4, a gate-in-panel (GIP) type in which the scan driver 130 is formed on the display panel 150 together with a thin film transistor process is shown as an example. However, the scan driver may be formed in a form of an integrated circuit (IC) like the data driver.

As shown in FIGS. 3 to 5, when flexibility is imparted to a substrate constituting the display panel 150, it is possible to deform the display panel 150 in a rolled shape or an unrolled shape.

However, elements (for example, thin film transistors in the subpixels SP) or the signal lines DL and GL formed in the display panel 150 are exposed to stresses transmitted in various directions every time the display panel 150 is deformed by bending.

For example, when the display panel 150 is rolled up and unrolled in the vertical direction y, as shown in (a) of FIG. 5, much stress is applied to the data lines DL as well as the elements SP. As another example, when the display panel 150 is rolled up and unrolled in the horizontal direction x, as shown in (b) of FIG. 5, much stress is applied to the scan lines GL as well as the elements SP.

When these stresses are constantly applied to the display panel 150, thin film layers constituting the elements SP or the signal lines DL and GL, etc. may cause physical and structural damage in a form of cracks or separation (pattern lifting), and measures are needed to mitigate them.

First Embodiment

Figure 6:
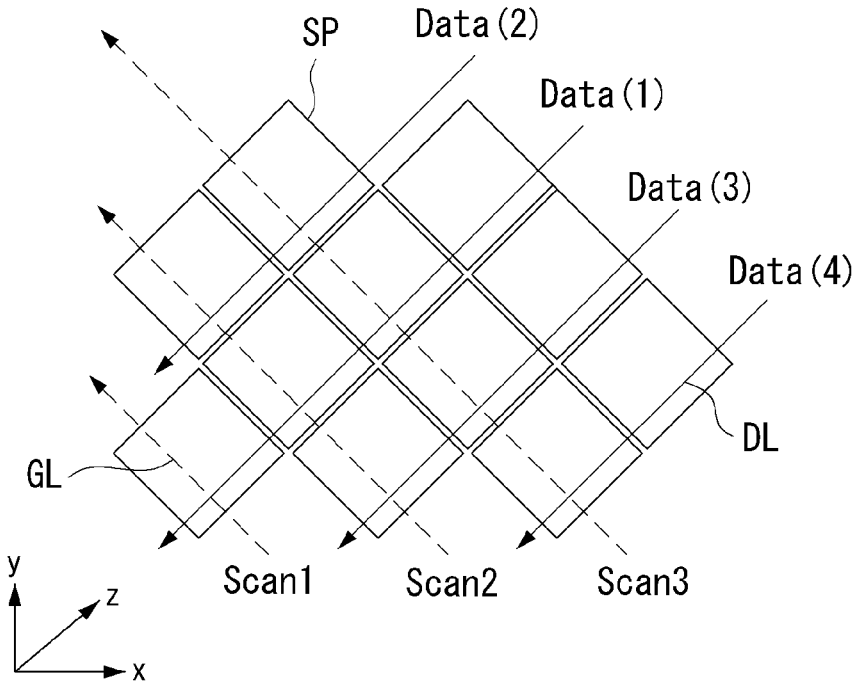
FIG. 6 is an exemplary view of subpixels arranged in a display panel of a first embodiment.
Figure 7:
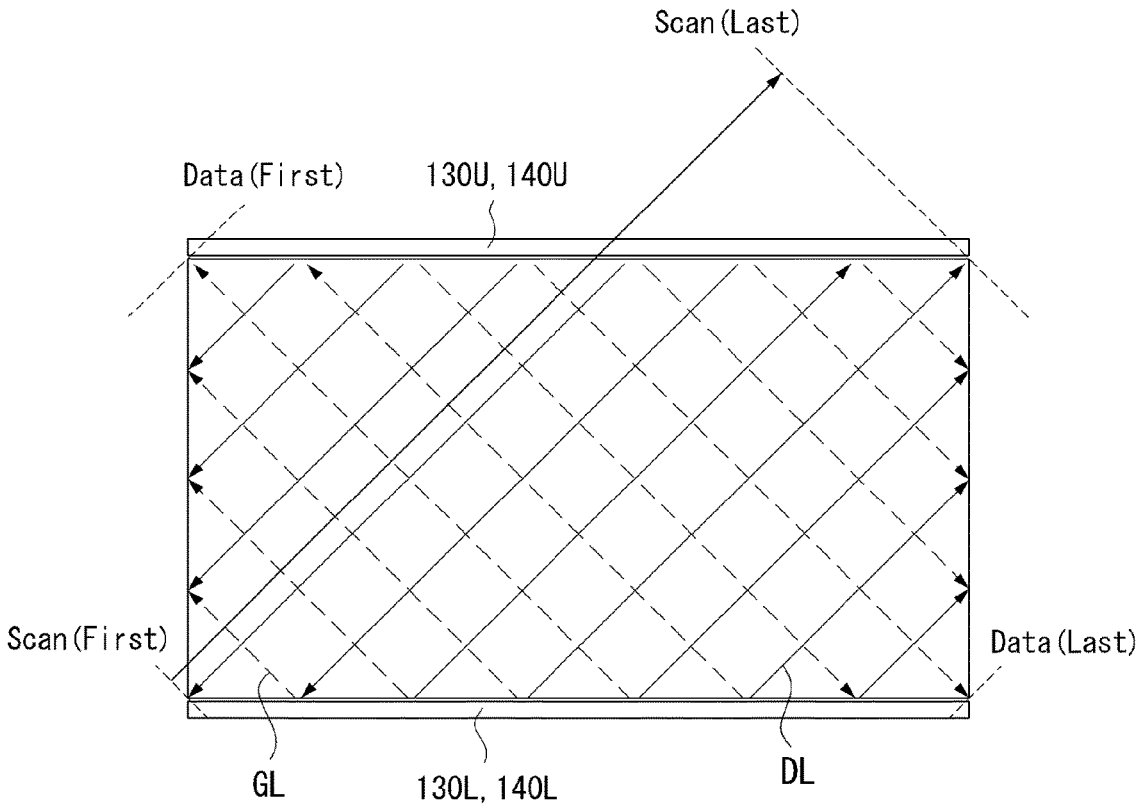
FIG. 7 is an exemplary view of signal lines arranged in a display panel of a first embodiment.
Figure 8:
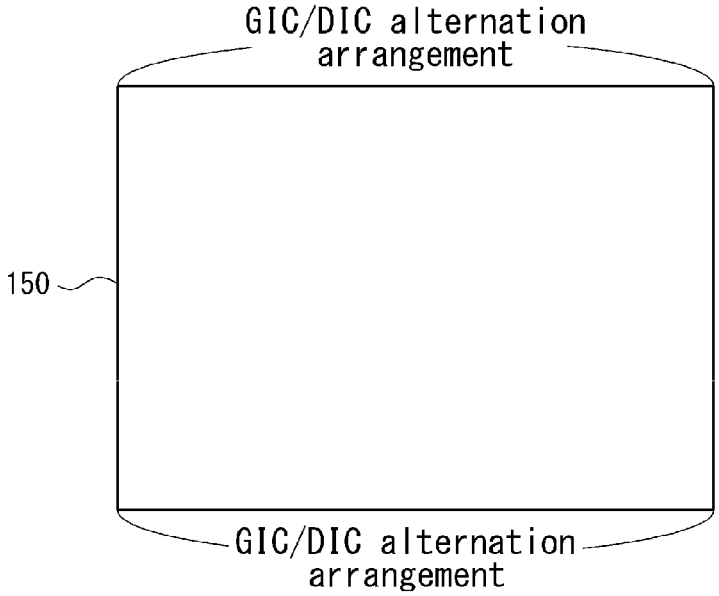
FIGS. 8 to 10 are exemplary views of drivers arranged on a display panel of a first embodiment.
Figure 8:
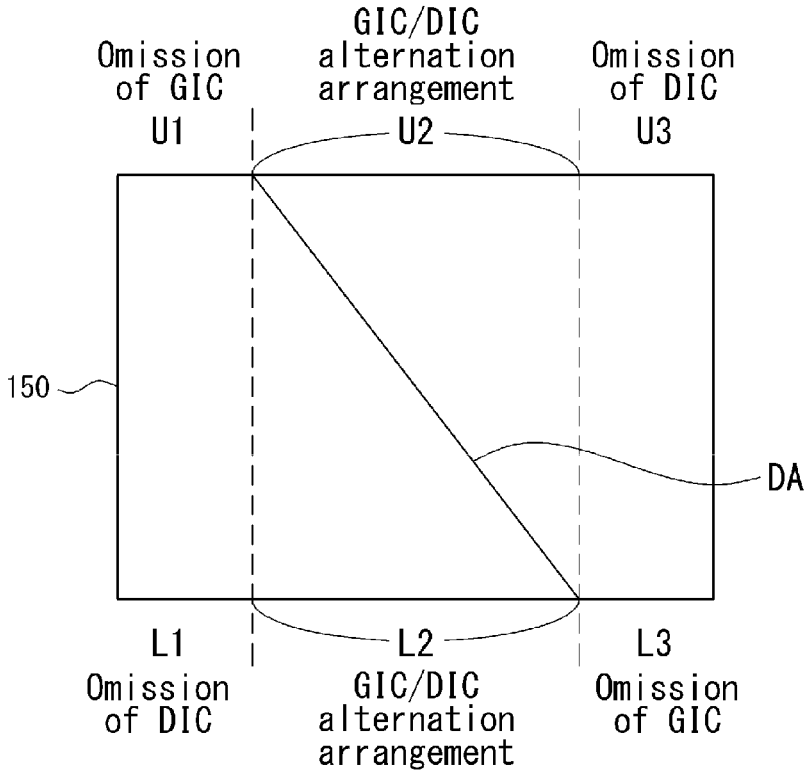
Figure 9:
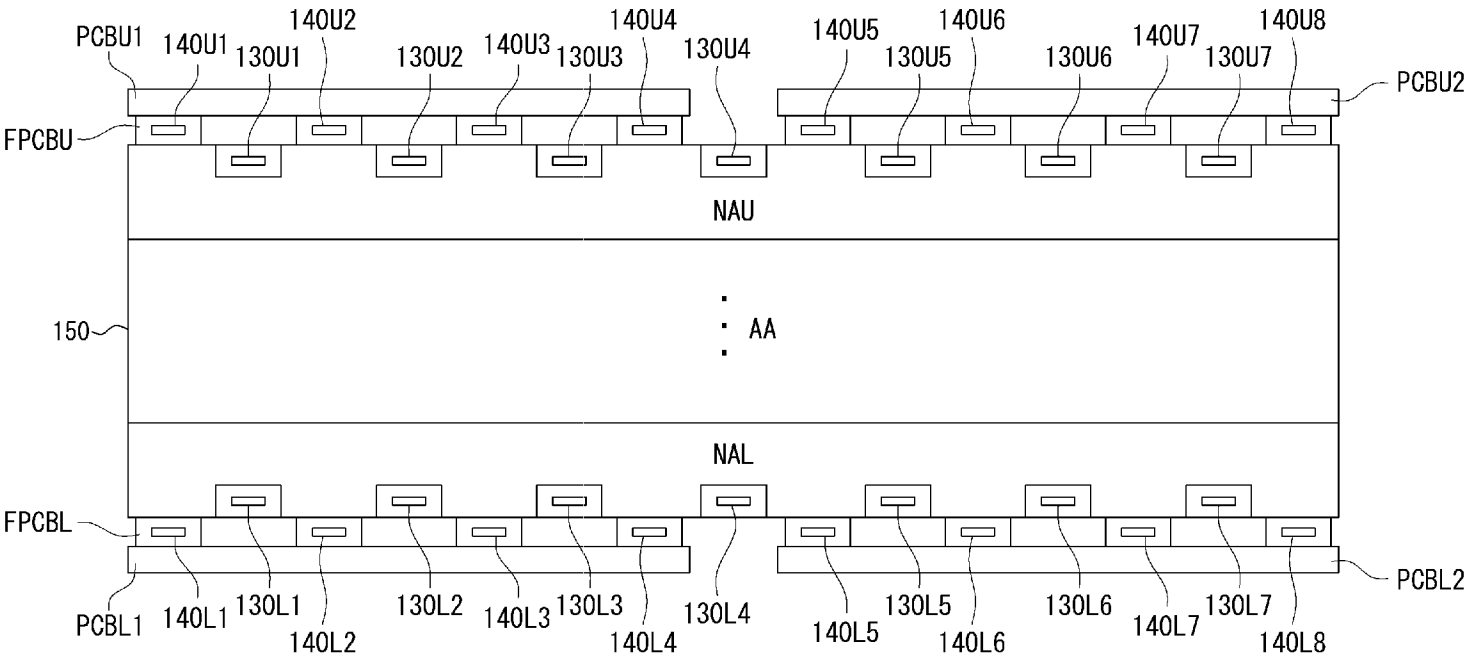
Figure 10:
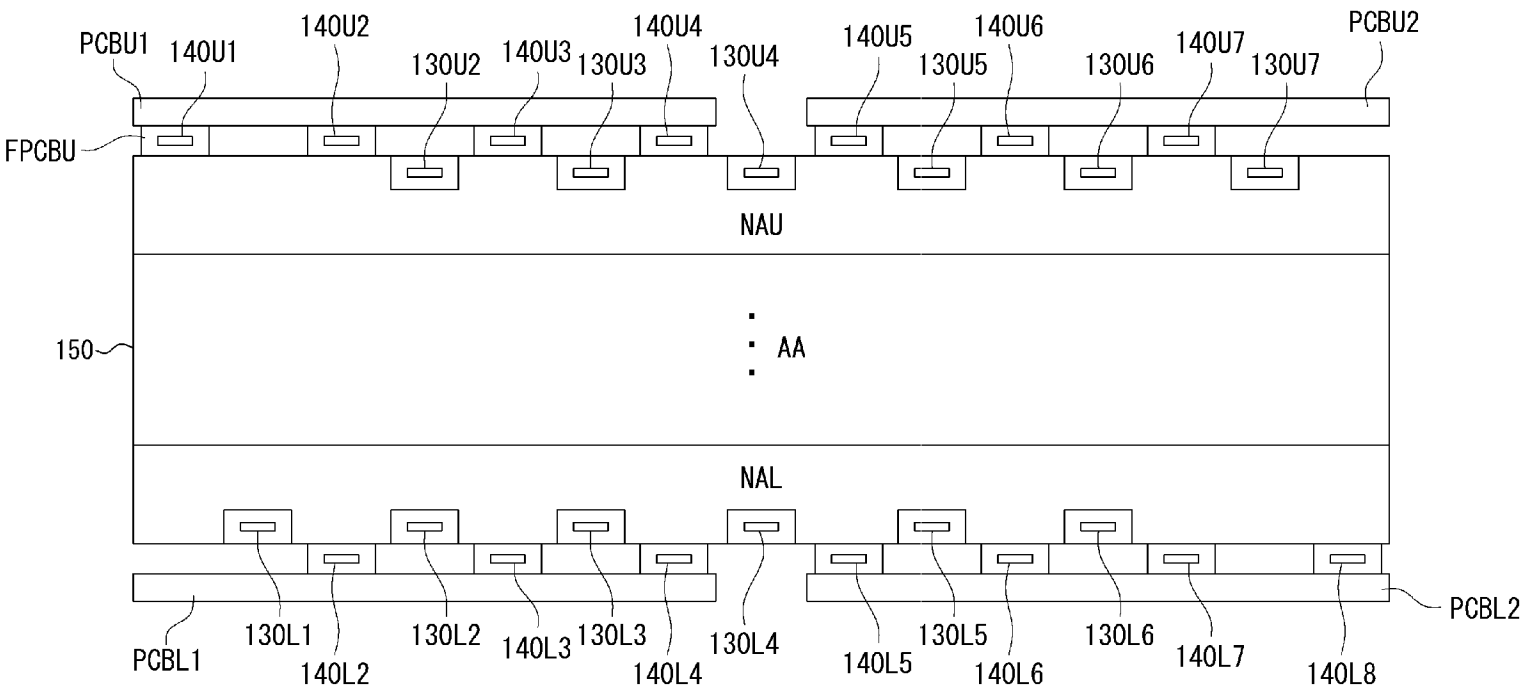

FIG. 6 is an exemplary view of subpixels arranged in a display panel of a first embodiment, FIG. 7 is an exemplary view of signal lines arranged in a display panel of a first embodiment, and FIGS. 8 to 10 are exemplary views of drivers arranged on a display panel of a first embodiment.

As shown in FIGS. 6 and 7, the subpixels SP are arranged in the display panel 150 of the first embodiment. The subpixels SP have a rhombic shape in which four sides have the same length or a length of two sides is longer than that of the other two sides. The subpixels SP are arranged in a matrix form along a z-axis (hereinafter, referred to as a diagonal direction) of the display panel 150.

Data lines DL are arranged in a first diagonal direction z of the display panel 150 and scan lines GL are arranged in a second diagonal direction (a direction intersecting z) of the display panel 150. Data drivers 140U, 140L for supplying a data signal through the data lines DL in the first diagonal direction z, and scan drivers 130U and 130L for supplying a scan signal through the scan lines GL in the second diagonal direction (a direction intersecting z) are arranged on an upper side and a lower side of the display panel 150. However, arrangement directions of the scan lines GL and the data lines DL may be reversed.

An upper data driver 140U transmits a data signal from an upper first diagonal direction to a lower first diagonal direction of the display panel 150. A lower data driver 140L transmits a data signal from the lower first diagonal direction to the upper first diagonal direction of the display panel 150.

The upper data driver 140U transmits the data signal from a first data line (First) located in the front to an M-th data line located in the middle. The lower data driver 140L transmits the data signal from an (M+1)th data line located in the middle to an N-th data line (Last) located in the end.

An upper scan driver 130U transmits a scan signal from an upper second diagonal direction to a lower second diagonal direction of the display panel 150. A lower scan driver 130L transmits a scan signal from the lower second diagonal direction to the upper second diagonal direction of the display panel 150.

The lower scan driver 130L transmits the scan signal from a first scan line (First) located in the front to a K-th scan line located in the middle. The upper scan driver 130U transmits the scan signal from a (K+1) th scan line located in the middle to an U-th scan line (Last) located in the end.

The scan drivers 130U and 130L may sequentially output the scan signals starting from a lower edge of the display panel 150 and ending at an upper edge of the display panel 150. The data drivers 140U and 140L may output the data signals in a non-sequential manner to correspond to the subpixels to which the scan signals are transmitted.

As shown in (a) of FIG. 5, when the display panel is rolled up and unrolled in the vertical direction y, compressive stress or tensile stress is applied to the data lines DL. When the process of rolling up and unrolling the display panel is repeated, adhesion of wirings decreases. At this time, a hillock phenomenon may occur at a portion where compressive stress is applied, and cracks occur in the data lines when stress is repeatedly applied. This phenomenon is also the same in (b) of FIG. 5.

However, as in the first embodiment, when the data lines and the scan lines are formed in diagonal directions, it is possible to reduce wiring length in a direction in which the display panel is rolled up (example: panel short axis length→embodiment: wiring width×$\sqrt{2}$) and reduce the cracks occurring in the data lines.

In another aspect, arranging the data lines and the scan lines in diagonal directions does not require a pad portion for mounting or forming a scan driver on left and right sides of the display panel. A structure of the embodiment has an effect of reducing a bezel region at the left and right sides of the display panel by about 2 mm. Further, in comparison with a display panel having a scan driver embedded in the display panel, there is no region occupied by circuits formed on the left and right sides of the display panel, so that the effect of reducing the bezel region can be obtained.

In addition, when a band-shaped display device is implemented based on the experimental example, images are not smoothly connected at connection portions of the panel due to the right and left bezels of the display panel. On the other hand, when a band-shaped display device is implemented based on the embodiment, the right and left bezels of the display panel is reduced, so that images of boundary surface are smoothly connected and the effect can be enhanced.

The scan lines and the data lines are arranged as described above, the scan drivers and the data drivers may be arranged as follows to output the scan signal and the data signal to the scan lines and the data lines.

According to a first arrangement example shown in (a) of FIG. 8, a plurality of scan drivers GIC and data drivers DIC may be alternately arranged on the upper side and the lower side of the display panel 150. At this time, an order of alternation may be order of the scan driver GIC and the data driver DIC or order of the data driver DIC and the scan driver GIC.

According to a second arrangement example shown in (b) of FIG. 8, as in the first arrangement example, a plurality of scan drivers GIC and data drivers DIC may be alternately arranged on the upper side and the lower side of the display panel 150.

However, alternation arrangement regions U2 and L2 in which the scan driver GIC and the data driver DIC are alternately arranged exist in a central region of the display panel 150. Left and right sides of the alternation arrangement regions U2 and L2 of the display panel 150 have regions (hereinafter, referred to as omission regions) U1, U3, L1, and L3 in which at least one of the scan driver GIC and the data driver DIC is deleted or omitted.

A size of the alternation arrangement regions U2 and L2 in which the scan driver GIC and the data driver DIC are alternately arranged is larger than sum of all the omission regions U1, U3, L1, and L3 in which at least one of the scan driver GIC and the data driver DIC is omitted.

The first arrangement example and the second arrangement example will be illustrated and explained in further detail as follows.

According to the first arrangement example as shown in FIGS. 8 and 9, upper data drivers 140U1 to 140U8 and upper scan drivers 130U1 to 130U7 may be alternately arranged in an upper alternation region U2 of the display panel 150.

The upper scan drivers 130U1 to 130U7 may be arranged in a gate-in-panel form in an upper non-display region NAU of the display panel 150. On the other hand, the upper data drivers 140U1 to 140U8 may be arranged in a form of an integrated circuit (IC) on a flexible printed circuit board FPCBU. However, when the upper scan drivers 130U1 to 130U7 have a form of an integrated circuit (IC), they may also be arranged on the flexible printed circuit board FPCBU.

Lower data drivers 140L1 to 140L8 and lower scan drivers 130L1 to 130L7 may be alternately arranged in a lower alternation region L2 of the display panel 150. The lower scan drivers 130L1 to 130L7 may be arranged in a gate-in-panel form in a lower non-display region NAL of the display panel 150.

On the other hand, the lower data drivers 140L1 to 140L8 may be arranged in a form of an integrated circuit (IC) on a flexible printed circuit board FPCBL. However, when the lower scan drivers 130L1 to 130L7 have a form of an integrated circuit (IC), they may also be arranged on the flexible printed circuit board FPCBL.

The upper data drivers 140U1 to 140U8 are electrically connected to upper printed circuit boards PCBU1 to PCBU2 arranged on the upper side, and the lower data drivers 140L1 to 140L8 are electrically connected to lower printed circuit boards PCBL1 to PCBL2 arranged on the lower side.

Although not shown, the upper printed circuit boards PCBU1 to PCBU2 and the lower printed circuit boards PCBL1 to PCBL2 are electrically connected to a control board on which a timing controller is mounted. AA is a display region in which the images are displayed on the display panel 150.

According to the second arrangement example as shown in FIGS. 8 and 10, a first upper scan driver 130U1 existing in an upper left omission region U1 of the display panel 150 and an eighth upper data driver 140U8 existing in an upper right omission region U3 of the display panel 150 may be deleted. A first lower data driver 140L1 existing in a lower left omission region L1 of the display panel 150 and a seventh lower scan driver 130L7 existing in a lower right omission region L3 of the display panel 150 may be deleted.

However, sizes of the omission regions U1, U3, L1, and L3 and the number of the scan driver and the data driver that are omitted are not limited thereto, and may vary depending on size and resolution of the display panel 150.

On the other hand, the reason why the structure of the second arrangement example is possible is that the scan driver and data driver in the vicinity of the edge of the display panel 150 can sufficiently transmit the scan signal and the data signal through the scan lines and the data lines existing in the omission regions. By using such an omission structure, there is a cost saving effect by the omission (or deletion) of the drivers when a large display panel is implemented.

Hereinafter, a method of driving a rollable display device according to a first embodiment of the invention will be described. On the other hand, the following driving method will be described based on the second arrangement example having the omission regions in which the scan and data drivers are omitted as shown in (b) of FIG. 8 and FIG. 10.

Figure 11:
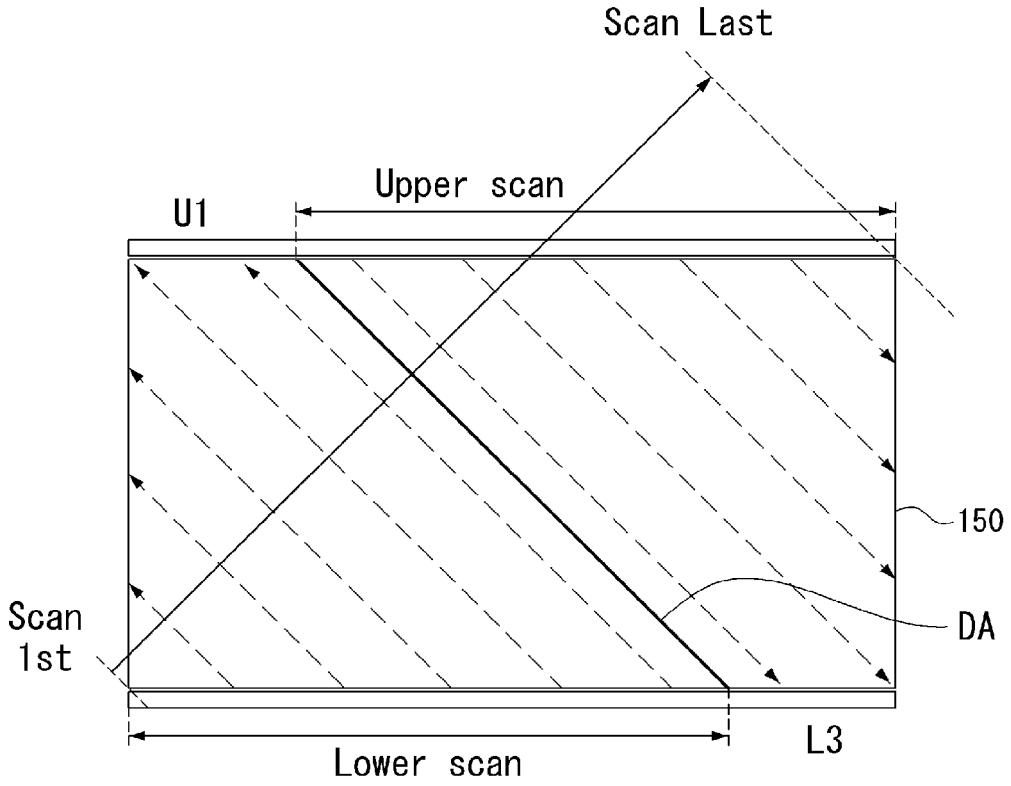
FIGS. 11 and 12 are views for illustrating a method of scanning according to a first embodiment.
Figure 12:
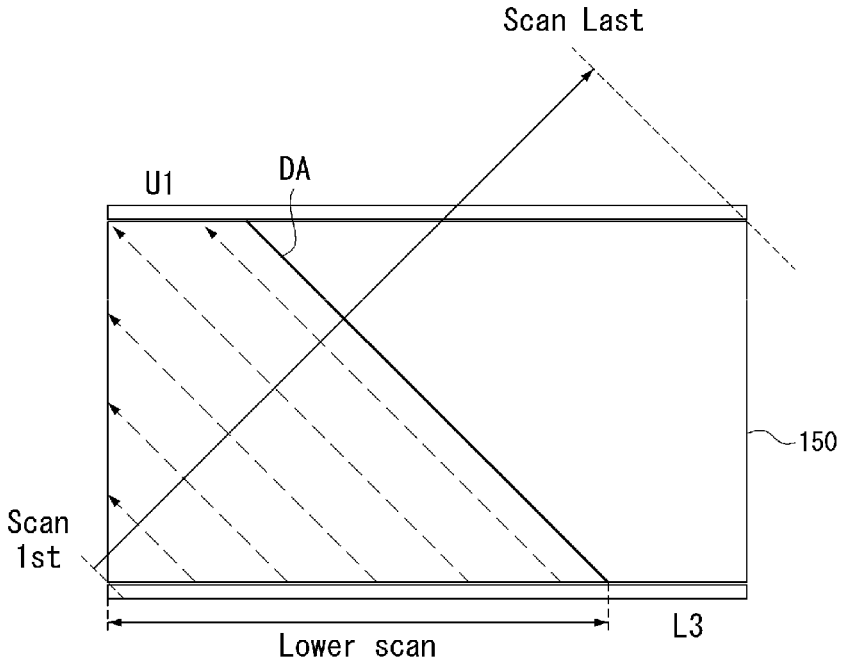
Figure 12:
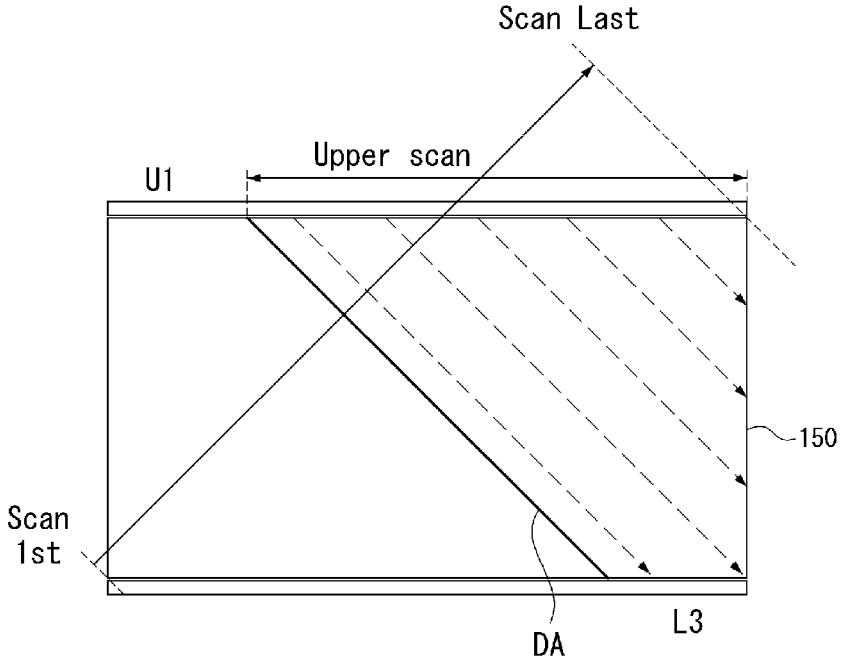

FIGS. 11 and 12 are views for illustrating a method of scanning according to a first embodiment.

In the method of scanning according to the first embodiment, scan signals are sequentially output from a lower end of the display panel to an upper end of the display panel. However, the method of scanning according to the first embodiment is not limited thereto. In the method of scanning, scan signals may be sequentially output from the upper end of the display panel to the lower end of the display panel.

According to the first embodiment shown in (b) of FIG. 8 and FIGS. 10 and 11, the display panel 150 has a lower scan region in which scanning is performed from a lower second diagonal direction to an upper second diagonal direction and an upper scan region in which scanning is performed from the upper second diagonal direction to the lower second diagonal direction.

There are no scan drivers in the lower right omission region L3 of the display panel 150 and the upper left omission region U1 of the display panel 150. The lower scan region and the upper scan region are defined by a dividing line DA connecting the lower right omission region L3 and the upper left omission region U1 existing in the display panel 150. As a result, a ratio of the lower scan region to the upper scan region on the display panel 150 can be 1:1.

As shown in (a) of FIG. 12, lower scan drivers transmit a scan signal from the lower second diagonal direction to the upper second diagonal direction of the display panel 150. The lower scan drivers scan from a first scan line (Scan 1st) located in the front of the lower scan region to a K-th scan line located in the end of the lower scan region.

As shown in (b) of FIG. 12, upper scan drivers transmit a scan signal from the upper second diagonal direction to the lower second diagonal direction of the display panel 150. The upper scan drivers scan from a (K+1)th scan line located in the front of the upper scan region to a U-th scan line (Scan last) located in the end of the upper scan region.

FIGS. 13 to 18 are views for illustrating a method of driving a rollable display device according to a first embodiment of the invention.

Figure 13:
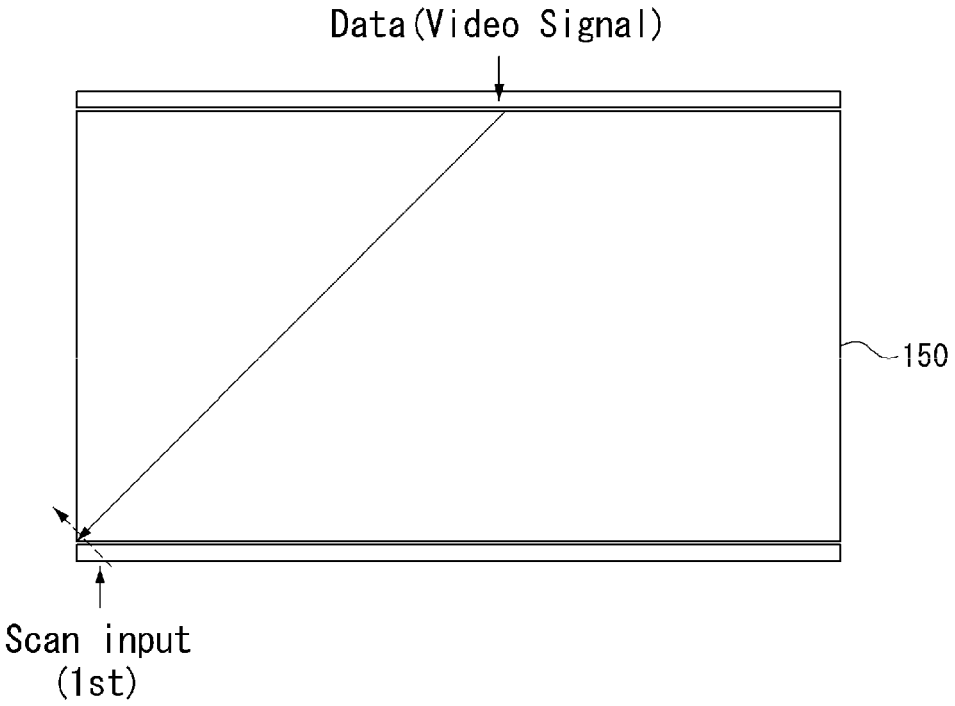
FIGS. 13 to 18 are views for illustrating a method of driving a rollable display device according to a first embodiment.

As shown in FIG. 13, lower scan drivers start to output a scan signal from a lower second diagonal direction to an upper second diagonal direction of the display panel 150. At this time, upper data drivers start to output a valid data signal (Data; Video Signal) to a lower first diagonal direction.

Figure 14:
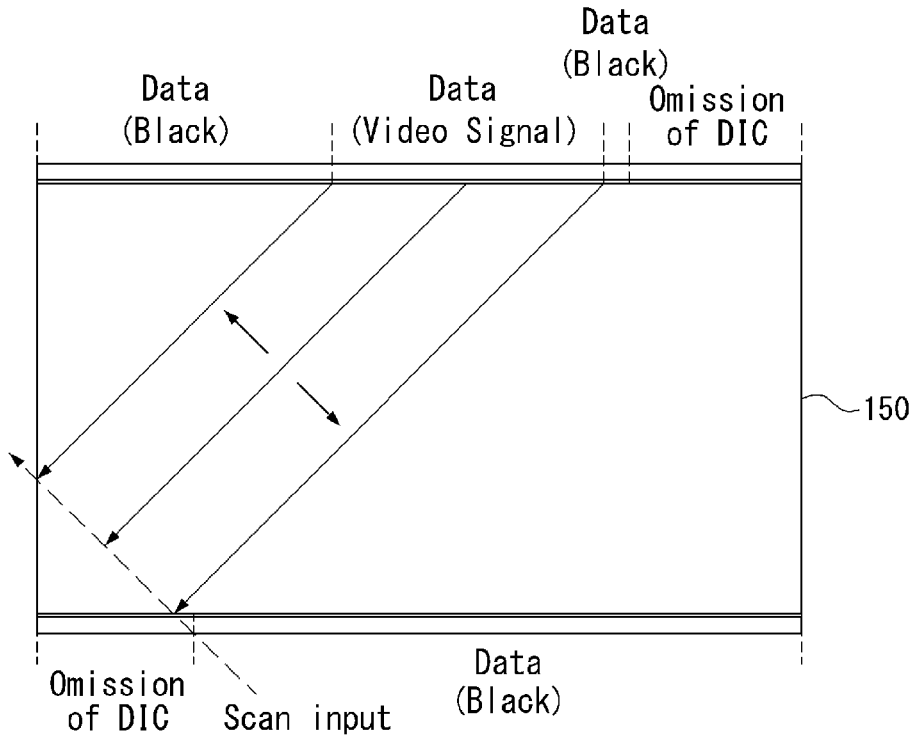
Figure 15:
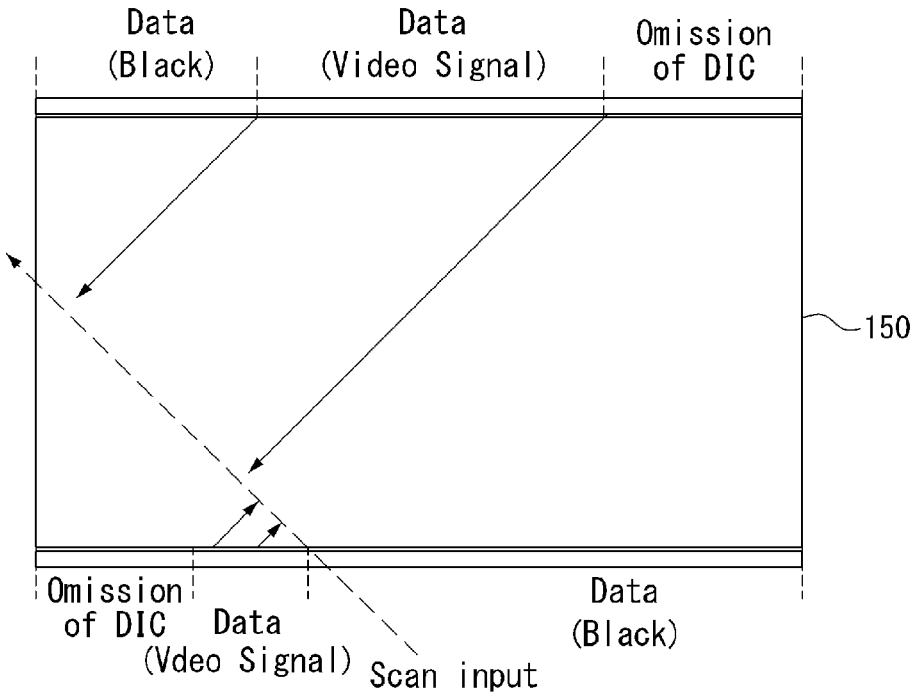
Figure 16:
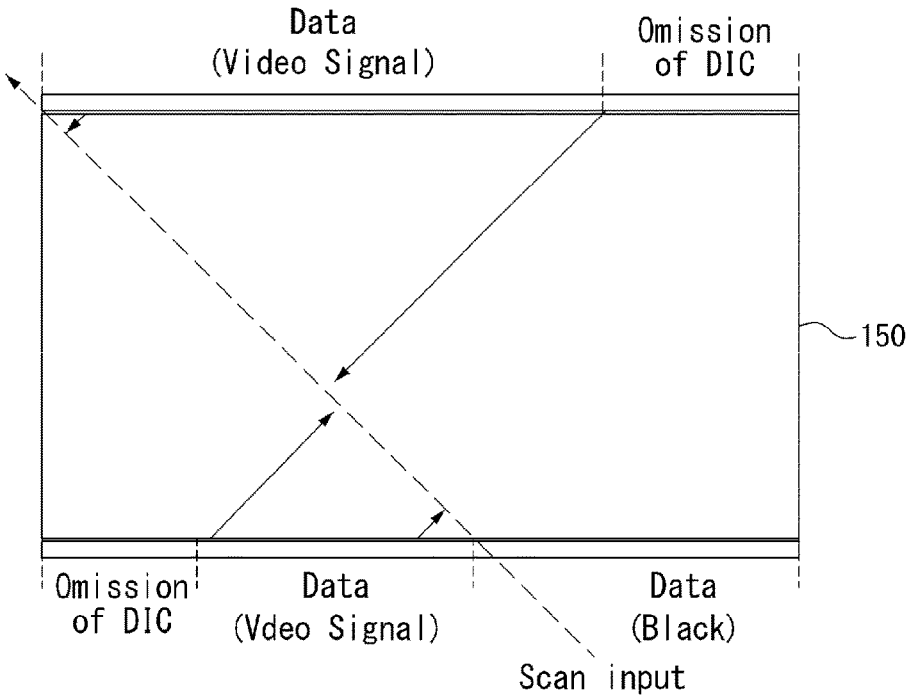

As shown in FIGS. 14 to 16, when a scan signal output region of the lower scan drivers increases, a data signal output region of the upper data drivers also increases. At this time, upper data drivers existing in a region not scanned by the lower scan drivers may output an invalid data signal (Data; Black) or become electrically floated. Accordingly, power consumption can be reduced by data drivers that output an invalid data signal or become electrically floated.

In this manner, when scanning from the first scan line (Scan 1st) to the K-th scan line included in the scan region of the lower scan drivers is completed, output of upper scan drivers and lower data drivers starts by a carry signal generated at this time.

Figure 17:
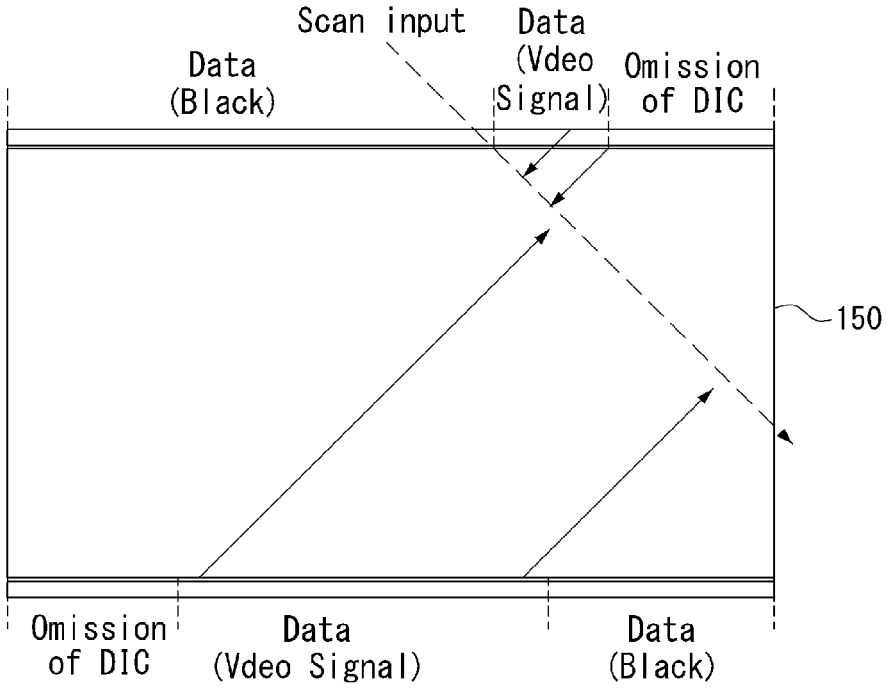
Figure 18:
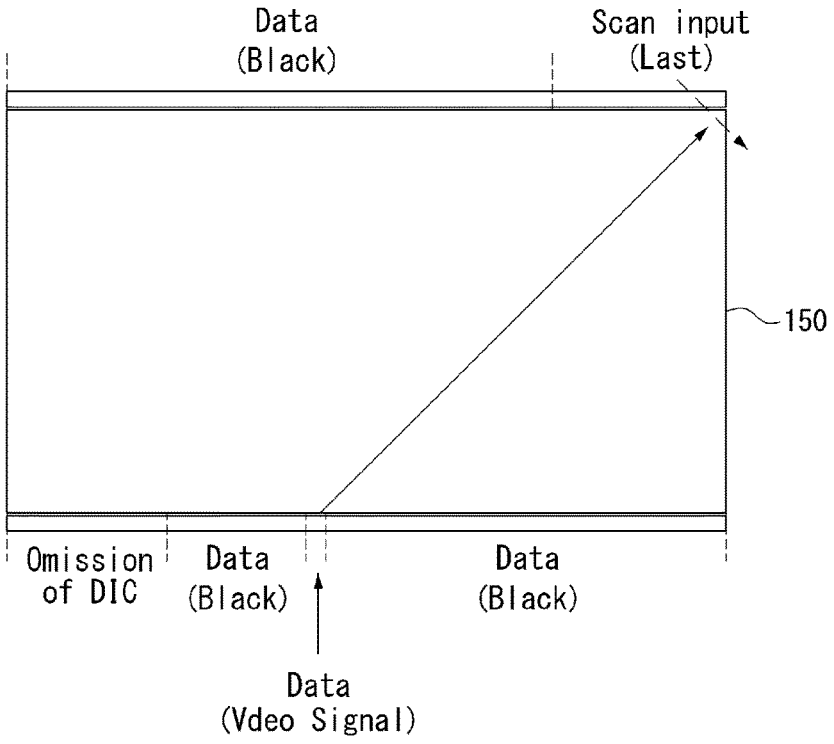

As shown in FIGS. 17 to 18, the upper scan drivers start to output a scan signal from the upper second diagonal direction to the lower second diagonal direction of the display panel 150. At this time, the lower data drivers start to output a valid data signal (Data; Video Signal) to an upper first diagonal direction.

When a scan signal output region of the upper scan drivers increases, a data signal output region of the lower data drivers also increases. At this time, lower data drivers existing in a region not scanned by the upper scan drivers may output an invalid data signal (Data; Black) or become electrically floated.

In the above description, the output of the scan signal means that a scan high voltage (or scan signal of logic high) is output. Sequential output of the scan signal means that, when a first scan driver and a second scan driver are present, an output of the second scan driver starts sequentially after an output of the first scan driver is completed.

Non-sequential output of the data signal means that, when a first data driver and a second data driver are present, outputs of the first and second data drivers do not occur at the same time and, also, do not occur in order.

In addition, in a data driver, a specific output channel (for example, a first output channel) may output a valid data signal while another specific output channel (for example, a second output channel, the second output channel is adjacent to or non-adjacent to the first output channel) may output an invalid data signal. To this end, the data driver may output a valid data signal to output channel(s) connected to sub-pixel(s) scanned by the scan signal and output an invalid data signal to output channel(s) connected to subpixel(s) that are not scanned by the scan signal. However, the data driver is not limited thereto.

Since the first embodiment drives the display panel based on the sequentially outputted scan signals, the first embodiment can provide a structure that is resistant to shape deformation of the display panel while driving the same as a conventional one.

Second Embodiment

Figure 19:
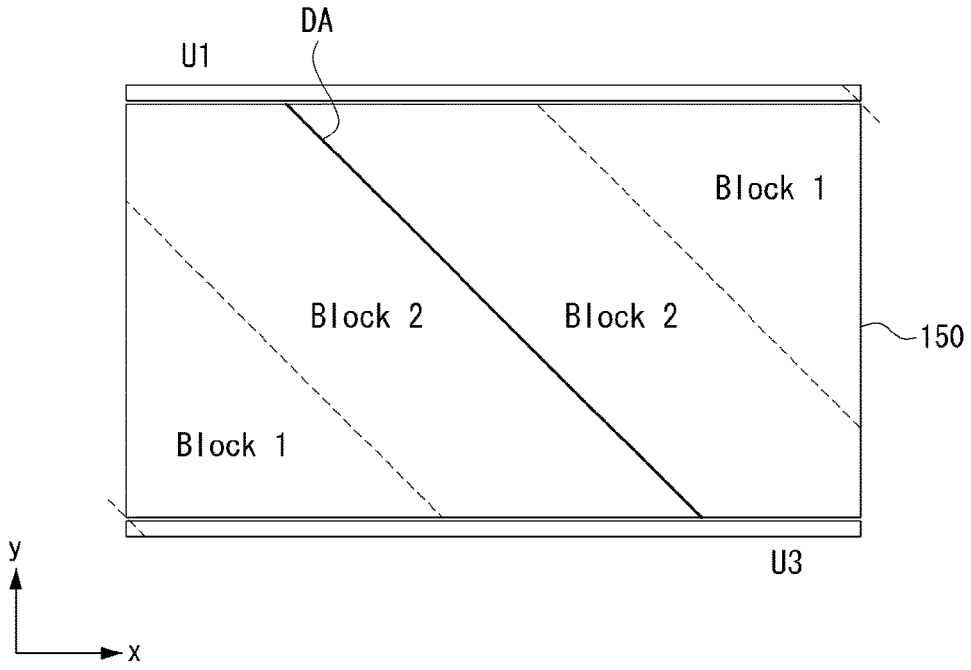
FIGS. 19 and 20 are views for illustrating a method of scanning according to a second embodiment.
Figure 20:
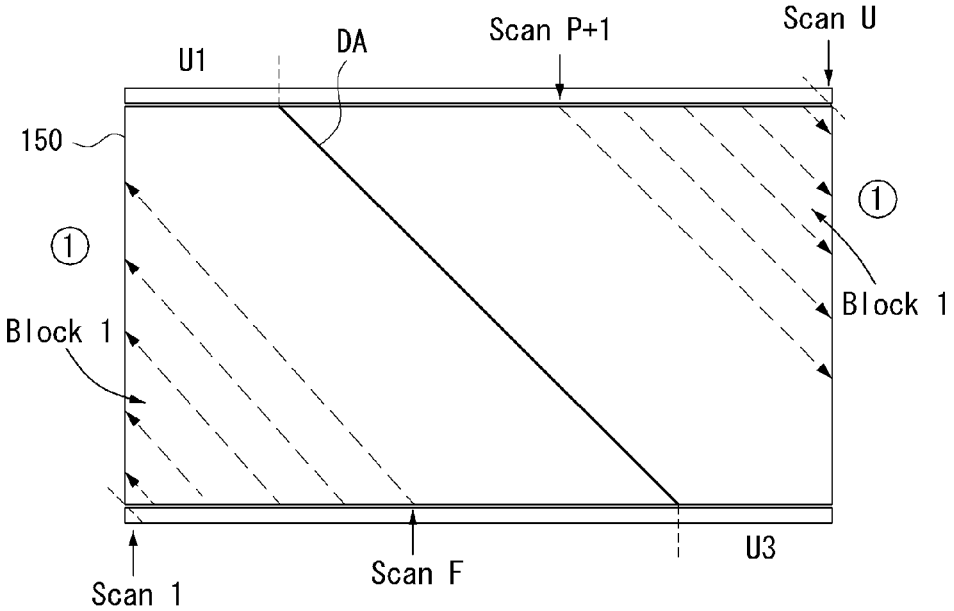
Figure 20:
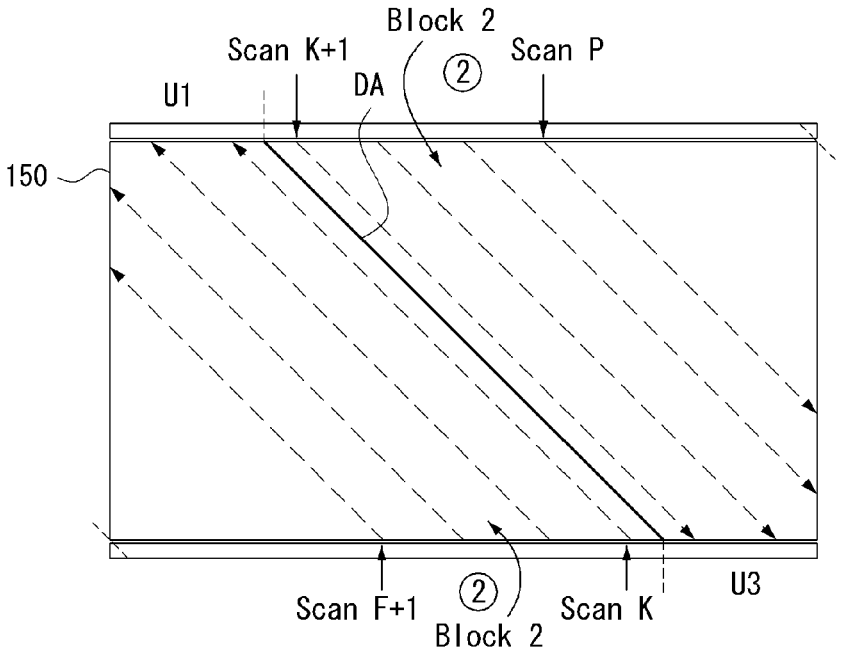

FIGS. 19 and 20 are views for illustrating a method of scanning according to a second embodiment.

In the method of scanning according to the second embodiment, a display panel is divided into at least two blocks and the divided blocks are simultaneously scanned. The display panel of the second embodiment, as in the first embodiment, is also constructed and arranged with scan lines, data lines, scan drivers, and data drivers. Therefore, at least two blocks are defined along a diagonal direction of the display panel.

On the other hand, in the second embodiment, it is explained only how the method of scanning the display panel is different from that in the first embodiment. Therefore, the structure and arrangement of the display panel, the scan drivers, the data drivers, and the like are described with reference to FIGS. 6 to 10.

The second embodiment also outputs a data signal in the same manner as in the first embodiment, but description of the output of the data signal is omitted in order to avoid redundant description because only the method of scanning is changed.

According to the second embodiment of the invention shown in (b) of FIG. 8 and FIGS. 10 and 19, the display panel 150 has a lower scan region in which scanning is performed from a lower second diagonal direction to an upper second diagonal direction and an upper scan region in which scanning is performed from the upper second diagonal direction to the lower second diagonal direction. In the second embodiment, a ratio of the lower scan region to the upper scan region on the display panel 150 also can be 1:1.

As described above, the second embodiment divides the lower scan region and the upper scan region of the display panel 150 into at least two blocks Block 1 and Block 2, respectively, and simultaneously scans a first block (e.g., Block 1) of the lower scan region and the upper scan region and a second block (e.g., Block 2) of the lower scan region and the upper scan region, respectively. That is, lower scan drivers and upper scan drivers have a period for simultaneously outputting a scan signal.

As shown in (a) of FIG. 20, some of the lower scan drivers transmit the scan signal from the lower second diagonal direction to the upper second diagonal direction of the display panel 150. Some of the lower scan drivers scan from a first scan line (Scan 1) located in the front of the lower scan region to a F-th scan line (Scan F) located in the middle of the lower scan region.

At the same time, some of the upper scan drivers transmit the scan signal from the upper second diagonal direction to the lower second diagonal direction of the display panel 150. Some of the upper scan drivers scan from a (P+1)th scan line (Scan P+1) located in the middle of the upper scan region to a U-th scan line (Scan U) located in the end of the upper scan region.

As described above, since scan signals are sequentially output from some of the lower scan drivers and some of the upper scan drivers at the same time, data signals are simultaneously transmitted to a left diagonal region and a right diagonal region of the display panel 150.

The left diagonal region and the right diagonal region may be defined as the first block, and driving steps thereof will be described as follows.

First lower scan drivers are driven to output a scan signal from the lower second diagonal direction to the upper second diagonal direction of the display panel 150, and first upper data drivers are driven to output a data signal from an upper first diagonal direction to a lower first diagonal direction of the display panel 150. First upper scan drivers are driven simultaneously with the first lower scan drivers to output a scan signal from the upper second diagonal direction to the lower second diagonal direction of the display panel 150, and first lower data drivers are driven simultaneously with the first upper data drivers to output a data signal from the lower first diagonal direction to the upper first diagonal direction of the display panel 150.

As shown in (b) of FIG. 20, remaining drivers of the lower scan drivers transmits a scan signal from the lower second diagonal direction to the upper second diagonal direction of the display panel 150. The remaining drivers of the lower scan drivers scan from a (F+1) th scan line (Scan F+1) located in the middle of the lower scan region to a K-th scan line (Scan K) located in the end of the lower scan region.

At the same time, remaining drivers of the upper scan drivers transmits a scan signal from the upper second diagonal direction to the lower second diagonal direction of the display panel 150. The remaining drivers of the upper scan drivers scan from a (K+1) th scan line (Scan K+1) located in the front of the upper scan region to a P-th scan line (Scan P) located in the middle of the upper scan region.

As described above, since scan signals are sequentially output from the remaining drivers of the lower scan drivers and the remaining drivers of the upper scan drivers at the same time, data signals are simultaneously transmitted to a central diagonal region existing between the left diagonal region and the right diagonal region of the display panel 150.

The central diagonal region may be defined as the second block, and driving steps thereof will be described as follows.

Second lower scan drivers are driven to output a scan signal from the lower second diagonal direction to the upper second diagonal direction of the display panel 150, and second upper data drivers are driven to output a data signal from the upper first diagonal direction to the lower first diagonal direction of the display panel 150. Second upper scan drivers are driven simultaneously with the second lower scan drivers to output a scan signal from the upper second diagonal direction to the lower second diagonal direction of the display panel 150, and second lower data drivers are driven simultaneously with the second upper data drivers to output a data signal from the lower first diagonal direction to the upper first diagonal direction of the display panel 150.

With the above-described driving method, the data signals can be supplied while simultaneously scanning at least two blocks while preventing mixing of the data signals.

In the above description, the scan signals and the data signals are transmitted simultaneously to region ① of (a) of FIG. 20, and then the scan signals and the data signals are simultaneously transmitted to region ② of (b) of FIG. 20. However, this is only one example. The scan signals and the data signals may be transmitted simultaneously to region ② of (b) of FIG. 20, and then the scan signals and the data signals may be simultaneously transmitted to region ① of (a) of FIG. 20.

Since the second embodiment simultaneously drives a specific region of the display panel based on the scan signals that are output in a non-sequential manner, it can provide a structure which is suitable for a display device requiring high-speed driving (for example, a large screen or a high resolution, etc.), and a structure that is resistant to shape deformation of the display panel.

As described above, the present disclosure has an effect of preventing physical and structural damage such as cracks and separation (pattern lifting) of a thin film when a display device is required to deform a display panel in a rolled shape or an unrolled shape. Further, the present disclosure has an effect that it is possible to provide a structure that is resistant to shape deformation of the display panel while being capable of high-speed driving. In addition, since the present disclosure does not require a driver to be attached to or form (including deletion of a pad portion for connection with a scan driver) on the left and right sides of the display panel, it is possible to provide a display device of narrow bezel which can minimize right and left bezel.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel configured to display an image;

a plurality of data lines arranged in a first diagonal direction of the display panel;

a plurality of scan lines arranged in a second diagonal direction intersecting the first diagonal direction of the display panel;

a plurality of data drivers connected to the plurality of data lines, wherein some of the plurality of data drivers output a data signal from an upper first diagonal direction to a lower first diagonal direction of the display panel during a first time period, and remaining drivers of the plurality of data drivers output a data signal from the lower first diagonal direction to the upper first diagonal direction of the display panel during a second time period that is subsequent the first time period; and a plurality of scan drivers connected to the plurality of scan lines.

2. The display device of claim 1, wherein the plurality of data drivers and the plurality of scan drivers are alternately arranged on an upper side and a lower side of the display panel.

3. The display device of claim 1, wherein a part of the plurality of scan drivers and a part of the plurality of data drivers are disposed on the left and right sides of the display panel, wherein the left and right sides of the display panel have an omission region in which at least one of the plurality of scan drivers and the plurality of data drivers is omitted.

4. The display device of claim 3, wherein the omission region on the left side of the display panel includes an upper left omission region which is on an upper left side of the display panel and a lower left omission region which is on a lower left side of the display panel, and the omission region on the right side of the display panel includes an upper right omission region which is on an upper right side of the display panel and a lower right omission region which is on a lower right side of the display panel, wherein at least one of the plurality of scan drivers is omitted in the upper left omission region of the display panel and the lower right omission region of the display panel, and wherein at least one of the plurality of data drivers is omitted in the upper right omission region of the display panel and the lower left omission region of the display panel.

5. The display device of claim 1, wherein at least one of the plurality of data drivers outputs a valid data signal through a first output channel of the at least one of the plurality of data drivers and outputs an invalid data signal through a second output channel of the at least one of the plurality of data drivers at the same time, and wherein the first output channel is a subpixel that is scanned by a scan signal and the second output channel is a subpixel that is not scanned by the scan signal.

6. The display device of claim 1, wherein some of the plurality of scan drivers output a scan signal from a lower second diagonal direction to an upper second diagonal direction of the display panel, and remaining drivers of the plurality of scan drivers output a scan signal from the upper second diagonal direction to the lower second diagonal direction of the display panel.

7. The display device of claim 1, wherein the plurality of scan drivers divide the display panel into at least two blocks and output a scan signal for simultaneously scanning the two divided blocks, and wherein the at least two blocks are defined along a diagonal direction of the display panel.

8. The display device of claim 1, further comprising:

a first flexible printed circuit board, wherein a first portion of the plurality of data drivers and a first portion of the plurality of scan drivers are connected to the first flexible printed circuit board; and a second flexible printed circuit board, wherein a second portion of the plurality of data drivers and a second portion of the plurality of scan drivers are connected to the second flexible printed circuit board.

9. A method of driving a display device including a display panel including subpixels defined by a plurality of data lines arranged in a first diagonal direction and a plurality of scan lines arranged in a second diagonal direction intersecting the first diagonal direction, comprising:

outputting a scan signal from a lower second diagonal direction to an upper second diagonal direction of the display panel by driving some of plurality of scan drivers, and outputting a data signal from an upper first diagonal direction to a lower first diagonal direction of the display panel by driving some of plurality of data drivers during a first time period; and outputting a scan signal from the upper second diagonal direction to the lower second diagonal direction of the display panel by driving remaining drivers of the plurality of scan drivers, and outputting a data signal from the lower first diagonal direction to the upper first diagonal direction of the display panel by driving remaining drivers of the plurality of data drivers during a second time period that is subsequent the first time period.

10. The method of claim 9, wherein in the outputting the data signal, at least one of the plurality of data drivers outputs a valid data signal through a first output channel of the at least one of the plurality of data drivers and outputs an invalid data signal through a second output channel of the at least one of the plurality of data drivers at the same time, and wherein the first output channel is a subpixel that is scanned by the scan signal and the second output channel is a subpixel that is not scanned by the scan signal.

11. A method of driving a display device including a display panel including subpixels defined by a plurality of data lines arranged in a first diagonal direction and a plurality of scan lines arranged in a second diagonal direction intersecting the first diagonal direction, comprising:

a first block driving step of outputting a scan signal from a lower second diagonal direction to an upper second diagonal direction of the display panel by driving first lower scan drivers, outputting a data signal from an upper first diagonal direction to a lower first diagonal direction of the display panel by driving first upper data drivers, outputting a scan signal from the upper second diagonal direction to the lower second diagonal direction of the display panel by driving first upper scan drivers simultaneously with the first lower scan drivers, and outputting a data signal from the lower first diagonal direction to the upper first diagonal direction of the display panel by driving first lower data drivers simultaneously with the first upper data drivers; and a second block driving step of outputting a scan signal from the lower second diagonal direction to the upper second diagonal direction of the display panel by driving second lower scan drivers, outputting a data signal from the upper first diagonal direction to the lower first diagonal direction of the display panel by driving second upper data drivers, outputting a scan signal from the upper second diagonal direction to the lower second diagonal direction of the display panel by driving second upper scan drivers simultaneously with the second lower scan drivers, and outputting a data signal from the lower first diagonal direction to the upper first diagonal direction of the display panel by driving second lower data drivers simultaneously with the second upper data drivers, wherein at least one of the plurality of data drivers outputs a valid data signal for displaying an image through a first output channel of the at least one of the plurality of data drivers and outputs an invalid data signal through a second output channel of the at least one of the plurality of data drivers at the same time, the invalid data signal comprising black data, and wherein the first output channel is a subpixel that is scanned by the scan signal and the second output channel is a subpixel that is not scanned by the scan signal.

12. The method of claim 11, wherein the first block driving step and the second block driving step are simultaneously performed.

* * * * *